United States Patent [19]

Lanzafame

[11] Patent Number: 4,471,595

[45] Date of Patent: Sep. 18, 1984

[54] CONSTRUCTIONAL BUILDING SET

[76] Inventor: Santo Lanzafame, 19 A$^{II}$, Classensgade, 2100 Copenhagen 0, Denmark

[21] Appl. No.: 476,246

[22] PCT Filed: Sep. 18, 1979

[86] PCT No.: PCT/DK79/00032

§ 371 Date: May 19, 1980

§ 102(e) Date: May 19, 1980

[87] PCT Pub. No.: WO80/00541

PCT Pub. Date: Apr. 3, 1980

Related U.S. Application Data

[63] Continuation of Ser. No. 192,519, filed as PCT DK79/00032, Sep. 18, 1979, published as WO80/00541, Apr. 3, 1980, § 102(e), dated May 19, 1980, abandoned.

[30] Foreign Application Priority Data

Sep. 19, 1978 [DK] Denmark ..... 4134/78

[51] Int. Cl.$^3$ ..... E04C 1/10

[52] U.S. Cl. ..... 52/584; 403/56; 403/143

[58] Field of Search ..... 52/584; 46/29, 31; 403/142, 143, 56, 64

[56] References Cited

U.S. PATENT DOCUMENTS

| | | | |
|---|---|---|---|
| 149,868 | 4/1874 | Keep | 403/64 |
| 1,543,037 | 1/1925 | Teeter . | |
| 2,029,532 | 2/1936 | Karcher | 287/12 |
| 2,422,302 | 6/1947 | Horn | 403/143 X |
| 2,526,045 | 10/1950 | Riemann | 403/56 |
| 2,683,329 | 7/1954 | Kobler | 46/29 |
| 2,763,500 | 9/1956 | Turner | 287/12 |
| 2,776,152 | 1/1957 | Ianuzzi | 287/12 |
| 3,648,404 | 3/1972 | Ogsbury et al. | 46/29 |
| 3,747,261 | 7/1973 | Salem | 46/26 |
| 3,822,499 | 7/1974 | De Vos | 46/26 |
| 4,225,258 | 9/1980 | Thompson | 403/56 |

FOREIGN PATENT DOCUMENTS

| | | |
|---|---|---|
| 53919 | 11/1937 | Denmark . |
| 576917 | 5/1933 | Fed. Rep. of Germany . |
| 808568 | 7/1951 | Fed. Rep. of Germany . |
| 1429502 | 11/1970 | Fed. Rep. of Germany . |
| 83065 | 9/1935 | Sweden . |
| 141953 | 9/1953 | Sweden . |
| 586042 | 3/1947 | United Kingdom . |
| 713589 | 5/1952 | United Kingdom . |

*Primary Examiner*—Carl D. Friedman

*Attorney, Agent, or Firm*—Kenneth P. Synnestvedt

[57] ABSTRACT

Improved constructional building set comprising as its basic elements a plurality of linking units, each linking unit comprising at least one connecting rod with a generally ball shaped head portion at each end thereof. A plurality of coupling members engage the head portions to couple the linking units. These coupling members have a clamping construction which tightens such that a pair of clamping members are urged toward each other about the rod head portions. Thus provided is a building set which is easy and inexpensive to manufacture and affords numerous possibilities of assembling stable structures. Such structure is useful not only as construction toys, but also for the construction of articles for everyday use.

17 Claims, 23 Drawing Figures

Figure 1:
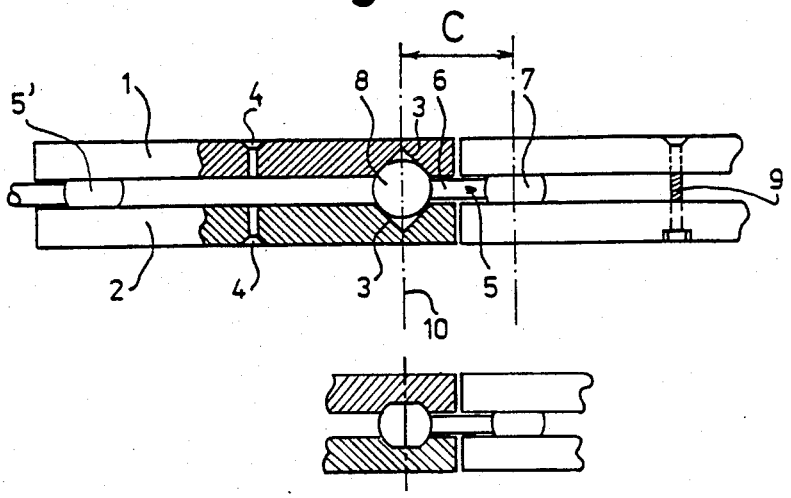

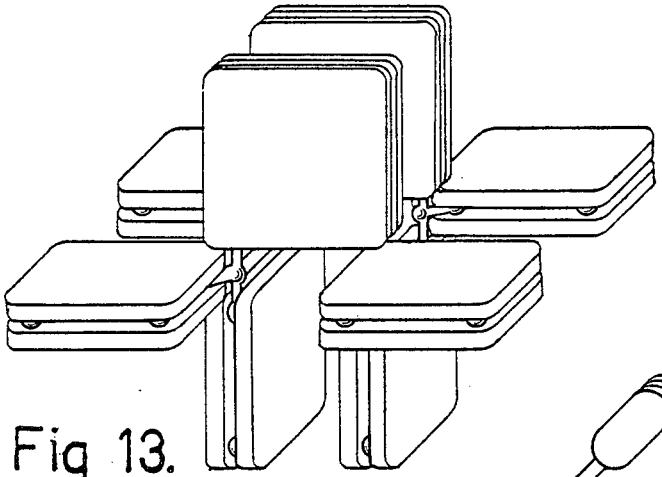
Fig 13.
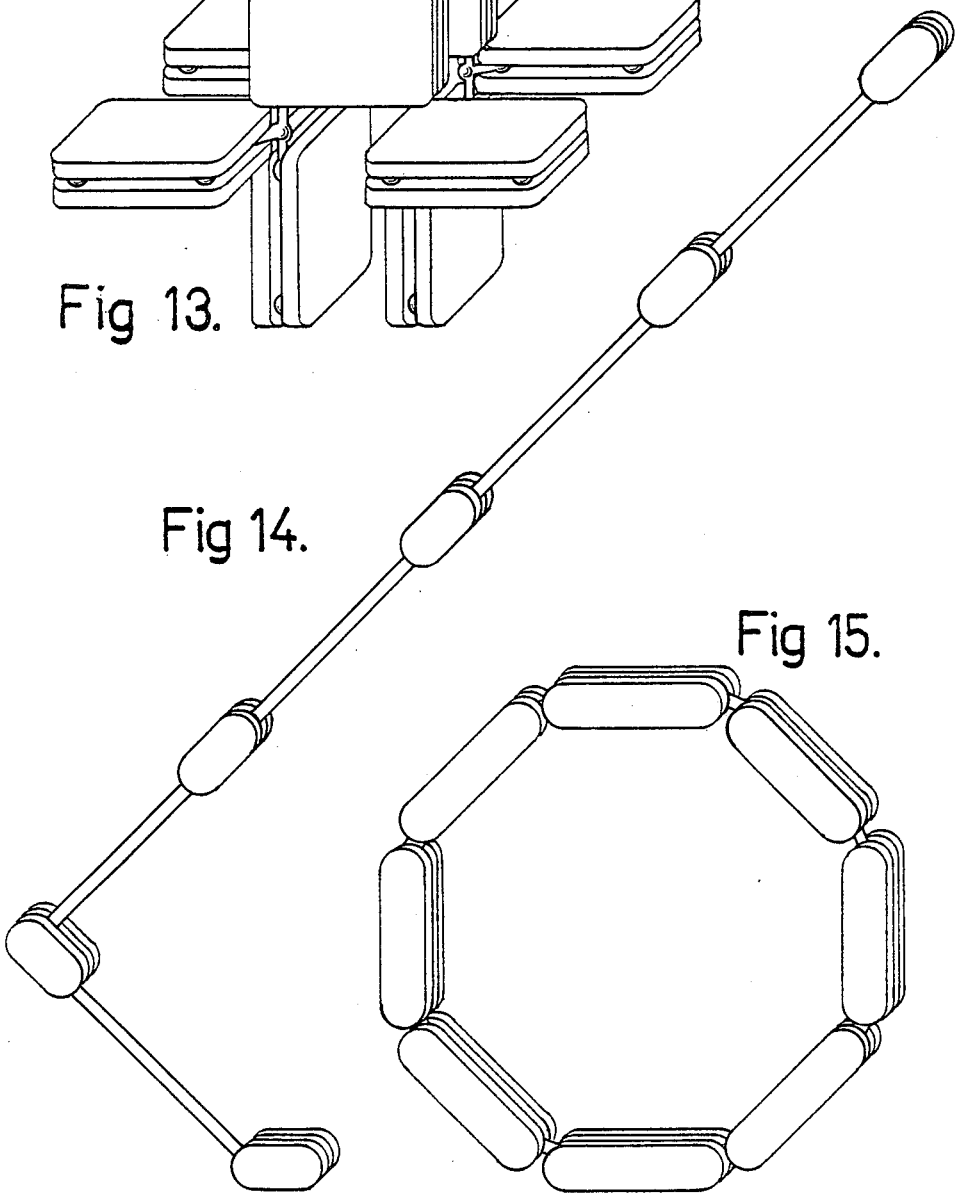
Fig 14.
Fig 15.

CONSTRUCTIONAL BUILDING SET

This application is a continuation of application Ser. No. 192,519, filed as PCT DK 79/00032, Sep. 18,1979, published as WO 80/00541, Apr. 3, 1980, § 102(e) date May 19, 1980, and now abandoned.

The present invention relates to building sets in general, and in particular to an improved constructional building set of the type comprising as its basic elements a plurality of linking units, each linking unit comprising at least one connecting rod having a generally ball-shaped head portion disposed at each end thereof, and a plurality of coupling members for coupling together linking units by use of said head portions thereof.

Various building sets have been proposed, for example as construction toys or engineering models or for use in constructing true articles or objects for everyday use such as furnitures. It is, however, a common feature to many prior building sets that the number of structures or assemblies which can be constructed are rather limited compared to the number of basic elements of the building sets.

Moreover, a stable or rigid structure, which has previously been built, cannot be changed without disassembling the structure completely or partially, or can only be changed to a limited extent.

U.S. Pat. No. 3,747,261 discloses a ball- and -socket joint for joining members together, in particular in constructing toys. The joint comprises a pair of balls, each having four flat spots lying in the same plane and spaced 90° from each other. A shaft or rod detachably interconnects the two balls and a generally spherically-shaped open socket is provided in a surface of each member to be joined. The or each socket is sized to snugly receive more than one half of the surface of a ball.

Such "undercut" sockets are, however, difficult to prepare in the surface of any member, and other structural features of the joint, such as various members which must fit snugly into each other, will also render the joint difficult and expensive to manufacture.

Due to its structure and design, the joint is, moreover, limited to joining of polyhedral members, whereby the number of stable assemblies, which can be constructed, becomes restricted.

U.S. Pat. No. 3,822,499 also relates to a building set which includes detachable linking units consisting of a cylindrical body portion interconnecting rounded spherical end pieces or head portions. Again, the number of stable assemblies, which can be constructed, is limited, because of the shape and design of the coupling means used which is cube-shaped plastic foam blocks.

On the above background, it is an object of the present invention to provide an improved constructional building set of the type here contemplated and as stated in the opening paragraph, the building set being easy and inexpensive to manufacture and the set providing numerous possibilities of assembling stable structures.

Another object is to provide a constructional building set useful not only as construction toys, but also for the construction of articles for everyday use.

These and other objects and advantages of the invention are attained by the characteristic features of the building set consisting in that the coupling members are clamping members having tightening means for urging a pair of clamping members toward each other about head portions of linking units with said head portions being retained in a manner known per se in respective recesses formed in at least one surface of said clamping members, said head portions of said linking units having such a size that, when inserted in and between registering recesses of two juxtaposed clamping members being urged together, they hold said two clamping members in spaced apart relation to each other.

A large varity and number of structures or articles can be built by use of very few basic elements and such structures or articles can, moreover, be made movable or changeable in a very simple manner as desired or needed and without disassembling the structure. Thus, the utility of the improved building set becomes considerably increased due to the fact that the couplings in a particular structure can be made movable or more or less rigid depending on how tight the individual pairs of clamping members in the structure have been clamped about the head portions of the linking units associated therewith.

Moreover, an assembly built by means of the improved set may easily be modified or adapted in view of various external conditions such as the available space just by untightening the tightening means of one or more pairs of clamping members in the assembly which, thereafter, can be changed or modified considerably. After such changes, the untightened tightening means can be retightened whereby the assembly can be made stable or rigid in its modified configuration.

The clamping members of the improved building set can have various shapes and designs. Thus the clamping members may be bars or plates, the term "plate" being understood in its broadest sense which does not imply that the members must necessarily have a uniform thickness. Thus, for example, spherical segments or spherical and other spatial shells can be used as clamping members. Moreover, the clamping members can be hollow profiles or, for examples, U-profiles. In such profiles, the recesses for the head portions of the linking units can be made by locally deforming the profile walls.

Figure 2:
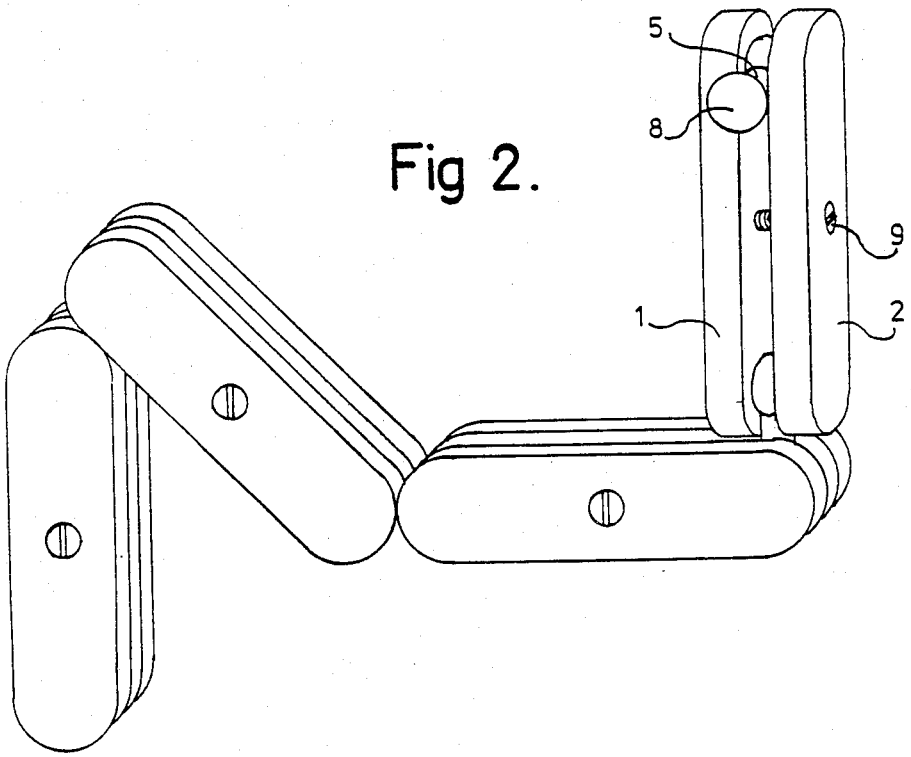
Figure 3A:
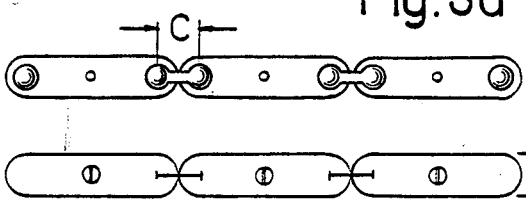
Figure 3B:
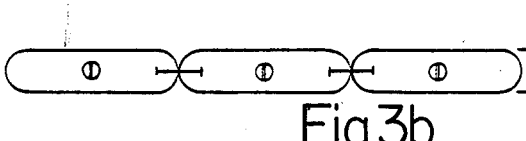
Figure 3C:
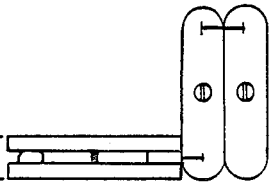
Figure 4A:
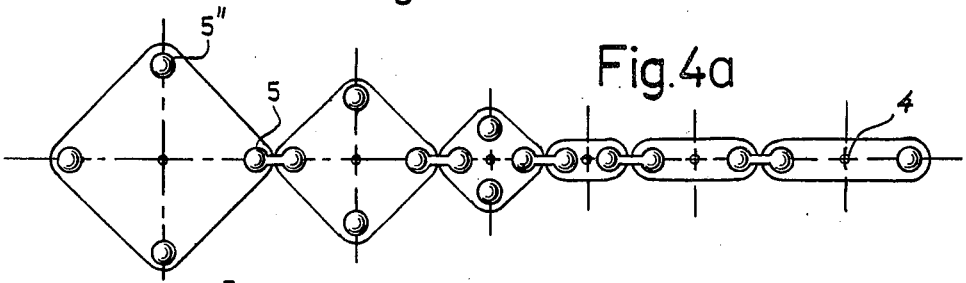
Figure 4B:
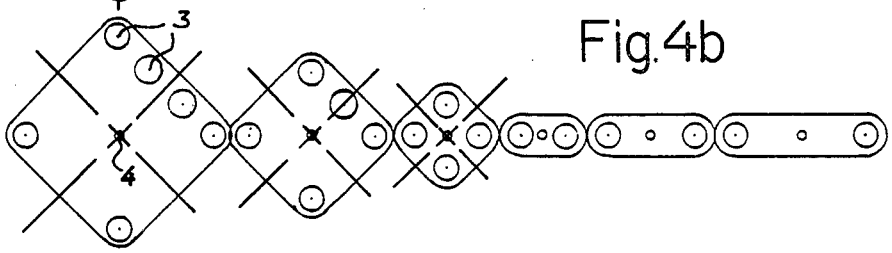
Figure 4C:
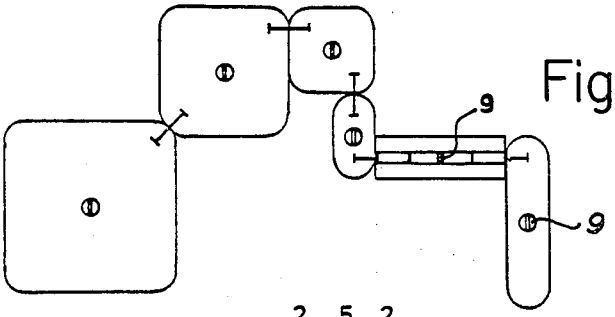
Figure 5A:
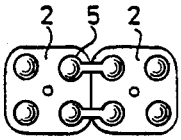
Figure 5B:
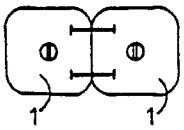
Figure 6:
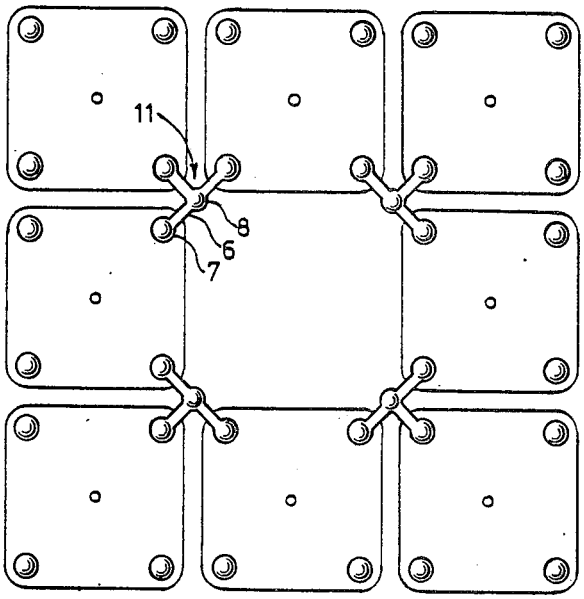
Figure 7:
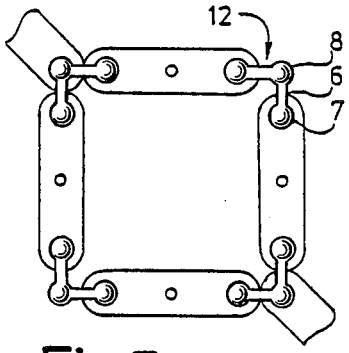
Figure 8:
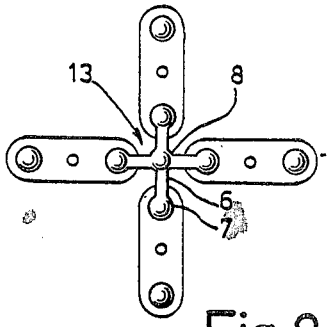
Figure 9:
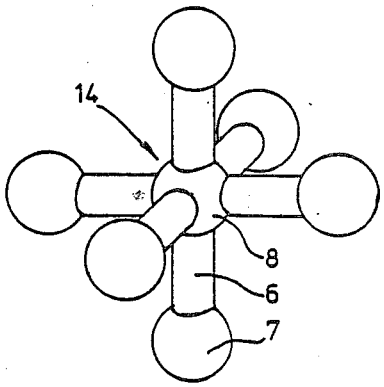

Various preferred embodiments and advantageous aspects of the improved constructional building set and elements being a part thereof will now be described, reference being made to the drawings wherein FIG. 1 is a view partially in section and illustrating the design of certain basic elements of the building set according to the invention and also illustrating the basic principle when using the building set, FIG. 2 is a perspective view illustrating certain possibilities of movements in a simple structure built by means of the set of the invention, FIG. 3*a* a plan view showing three bar-shaped clamping members with associated linking units and spacer balls inserted in respective recesses therein, FIG. 3*b* is a plan view of the elements of FIG. 3*a* being covered by corresponding or matching elements to complete the assembly, FIG. 3*c* a plan view illustrating certain possibilities of movements in the assembly of FIG. 3*b*, FIG. 4*a* is a plan view illustrating a series of further bar-shaped and plate-shaped clamping members having linking units and spacer balls inserted therein and being sized in accordance with a modular system, FIG. 4*b* is a plan view of a series of clamping members matching with the members of FIG. 4*a*, FIG. 4*c* is a plan view of the series of FIGS. 4*a* and 4*b* in assembled condition and with certain units being moved in various ways relative to each other, FIG. 5*b* is a plan view showing two plate-shaped clamping members with linking units and spacer balls inserted therein, FIG. 5*b* is a plan view showing the members of FIG. 5*a* covered by matching members to form a particularly rigid assembly, FIGS. 6–8 are respective plan views illustrating various building or assembling possibilities when using further developed linking units which may be included in a buiding set of the invention, FIG. 9 is a perspective view showing another particular type of linking unit which may be included in the building set of the invention, FIGS. 10–18 are respective perspective views illustrating various examples of possible uses of the building set.

Referring now to the drawings, FIG. 1 thereof illustrates the basic principle of the constructional building set of the invention. The basic elements of the building set are, as shown, clamping members 1 and 2 and linking units 5. The clamping member can be generally bar-shaped or plate-shaped and each member has recesses 3 at least in one surface thereof.

The recesses 3 should be arranged and shaped so that each recess in a first member 1 can be disposed to register a corresponding recess 3 in another member 2 when the two members are juxtaposed surface-to-surface as shown in FIG. 1. The recesses should in other words be placeable two by two on a common axis 10. Obviously, this could be attained by designing the clamping members in matching pairs of members belonging together, but in order to simplify the use of the building set, it is preferable that members of the same type are identical and have the recesses 3 therein arranged symmetrically about two orthogonal main axes for each member. FIG. 4 illustrates examples of such main axes. Each member 1 can thereby be matched with any other member 2 of the same type and thereby it is not necessary to pick out particular members in order to be able to make assemblies as that of FIG. 1 made of members 1 and 2.

The recesses 3 may have various shapes, the main thing being that they shall be able to retain and centre a head portion 7 or 8 of a linking unit 5 which will be described in the following, at an axis 10 which, upon matching two clamping members, is common to opposed recesses 3. Thus, the recesses can be rotary-symmetrical about the axis 10, but recesses having an inner surface shaped as a part of a spherical surface or as a conical surface are preferable.

As shown in FIG. 1 and as mentioned above, the recesses 3 are used to retain and centre generally ball-shaped head portions of linking units 5. A basic type of such linking units comprises a connecting rod 6 preferably being cylindrical in shape, and respective head portions 7, 8 disposed at each end of the connecting rod.

By use of such linking units 5, pairs of matching clamping members 1 and 2 can be coupled together when juxtaposed as illustrated in FIG. 1 and by tightening a screw or bolt 9 extending through appropriate openings 4 in the clamping members and preferably having countersunk screw or bolt heads.

FIG. 2 illustrates certain possibilities of movements in such an assembly. Thus, the pairs of clamping members can pivot relative to each other in a plane, for example as shown in the left part of FIG. 2. Moreover, each pair of clamping members can swivel or rotated about the longitudinal axis of the pair, for example as shown in the right part of FIG. 2. Thus, an assembly as that shown in FIG. 2 will be very suitable for use as supporting means for lamps such as table lamps or wall lamps and the lamp fitting and lamp socket of such lamps can be mounted on the free head portion 8 shown in FIG. 2 which could be specifically adapted and designed for that purpose. Similarly, the opposite outer pair of clamping members to the left in FIG. 2 could be particularly designed for attachment to or suspension on a wall surface.

The outer linking unit 5′ shown to the left in FIG. 1 could be replaced by a separate spacer ball 5″ belonging to the building set and having generally the same shape and size as the head portions 7 and 8. The linking unit 5′ could, furthermore, be provided with various particular means such as a mounting plate.

In accordance with the invention and as illustrated in the lower portion of FIG. 1, the head portions 7 and 8 can appropriately be provided with at least one pair of diametrically opposed flat surface areas. Thereby, and in connection with recesses 3 having a flat bottom surface, at least one position can be obtained in which the joint between two pairs of clamping members is particularly rigid, namely a position in which the flat surface areas contact the corresponding flat bottoms of the respective recesses. Thus, in a particular embodiment, each head portion can have a shape similar to a dodecahedron, thereby obtaining rather many possibilities of such particularly rigid joining positions.

FIGS. 3*a* and 3*b* illustrate the elements in an assembly similar to that shown in FIG. 2, whereas FIG. 3*c* illustrates how such an assembly can be completely folded together which is very useful, for example in connection with a support arm for a lamp. FIG. 3*c* also indicates how one pair of clamping members can be and has been rotated about a longitudinal axis relative to adjacent pairs of clamping members in the assmebly.

The clamping members in the building set of the invention can have several different plate- like or bar -like shapes or configurations. Preferably, however, shapes are used which are symmetrical about two main axes which are at right angles to each other, for example rectangles or squares. Moreover, various rotary-symmetrical forms such as regular polygons may be used for the clamping members.

In connection with such forms of clamping members, the opening 4 therein for screws or bolts can be provided in the intersecting point of the two main axes or in the central point of rotary-symmetrical members. At the corners of such members, there can, moreover, be provided a recess 3 which, according to the invention, can advantageously be arranged with its axis 10 being spaced from each of the edges which define the corner, the distance between such edges and the axis 10 being approximately one half of the distance C between the respective centers of the head portions 7, 8 (FIG. 1).

With such an arrangement, two pairs of clamping members which are coupled together will adjoin each other rather closely, e.g. as shown in FIG. 1. The pairs of clamping members can thereby lean against each other, whereby the joint between two pairs becomes particularly resistant to bending stresses acting in the plane of the paper in FIG. 1.

The corners of the clamping members or at least those corners at which a recess 3 is present may, moreover, be rounded off with a rounding radius which is one half the center spacing C. Thereby, the rigity or resistance to bending stresses just mentioned will still be obtained and, moreover, it is obtained that two joined pairs of clamping members can pivot or be swung relative to each other into a closely folded position, for example as the two pairs of clamping members shown to the right in FIG. 3*c*.

In addition, and in accordance with the invention, the width of the clamping members can also appropriately equal the center distance C, whereby the end portions of members of that type will have a semi-circular contour. Accordingly, two pairs of clamping members of that design and being joined to each other by means of a linking unit, can pivot or be swung in both directions and in both instances the two pairs of clamping members can be folded closely together lying side edge against side edge.

According to the invention, the shape of the recesses 3 and the size of the head portions 7, 8 are preferably adjusted or adapted so that two clamping members 1, 2 which have been tightened as shown in FIG. 1, have an overall height which also equals the center distance C. Thereby it is obtained that a pair of clamping members which has been rotated 90° about its longitudinal axis, e.g. as shown in FIG. 3*c*, will not break an otherwise continuous or flat surface in an assembly.

FIGS. 4*a* and 4*b* illustrate two series of clamping members which show the features mentioned above. The individual members can be of different length and if desired or necessary, for example particularly long members, can be provided with several openings 4 for screws or bolts, if the symmetry of the members is maintained thereby.

The clamping members of the building set of the invention are preferably arranged and designed in accordance with an appropriate modular system and FIGS. 4*a* and 4*b* show an example of such a system. Thus, the smallest square plate member shown corresponds to two of the shortest bar member shown. Similarly, the middle-sized square plate member corresponds to three of the middle-sized bar member shown, and, finally, the biggest square plate member shown corresponds to four of the longest bar member shown.

In connection with a modular system as that illustrated, the middle-sized and the biggest square plate members may also be provided with recesses 3 at intermediate points along the plate member edges as indicated in FIG. 4*b*.

With an arrangement of linking uints 5 and spacer balls 5″ as that shown in FIG. 4*a*, the two series of clamping members which include clamping members being identical two by two, can be joined in many different positions, for example the position shown in FIG. 4*c*, wherein there may be one or more links which are more or less movable, depending on how tightly the members of the individual pairs of members have been clamped together.

In the assemblies described above, only basic linking units as unit 5 described in connection with FIG. 1, have been used. In accordance with the invention, this basic unit may, however, be further developed by adding thereto one or more further connecting rods which are connected with one of the head portions, e.g. the head portion 8, each such further connecting rod being provided with a similar head portion at its outer free end.

FIGS. 6–9 illustrate examples of such further developed linking units and examples of the utility of such units. Thus, FIG. 6 shows T-shaped linking units 11, and FIG. 7 shows angular units 12. As indicated in FIG. 7, the head portion 8 at the middle of the angular units 12 may also be used for joining further clamping members to the assembly.

FIG. 8 illustrates a cross-shaped unit 13, whereas FIG. 9 illustrates a three-dimensional linking unit 14 in larger scale and wherein the connecting rods extend as the axes of a right-angled spatial coordinate system with the head portion 8 in the center thereof.

In addition to the linking elements shown, the building set may also include a linking unit, wherein three connecting rods extend in accordance with the edges of a three- dimensional right-angled corner.

Figure 10:
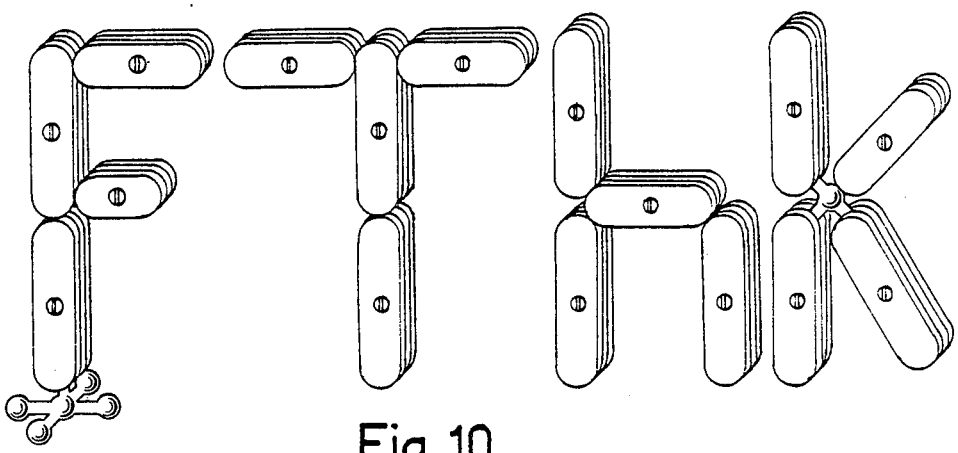
Figure 11:
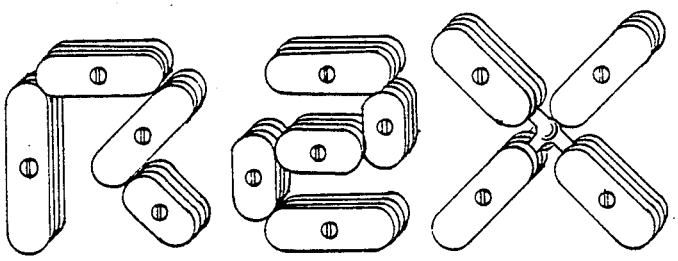
Figure 12:
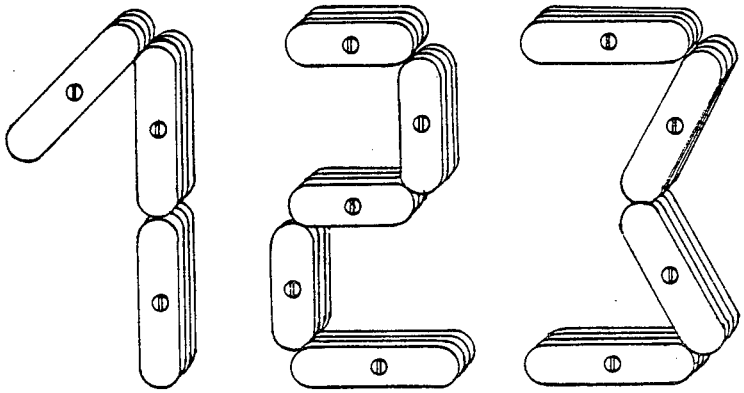

By means of such further developed linking units, the building possibilities will be considerably enhanced. FIGS. 10–18 illustrate various examples of areas of use and building possibilities for the building set according to the invention. Thus, FIGS. 10–12 illustrate examples of how letters and symbols, e.g. for advertising purposes, can be built. FIGS. 13–15 show examples of decorative structures, FIG. 14 showing an example in which the linking units have extended connecting rods.

Figure 16:
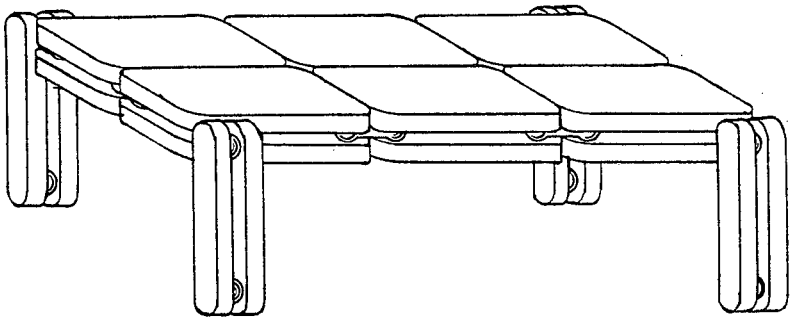
Figure 17:
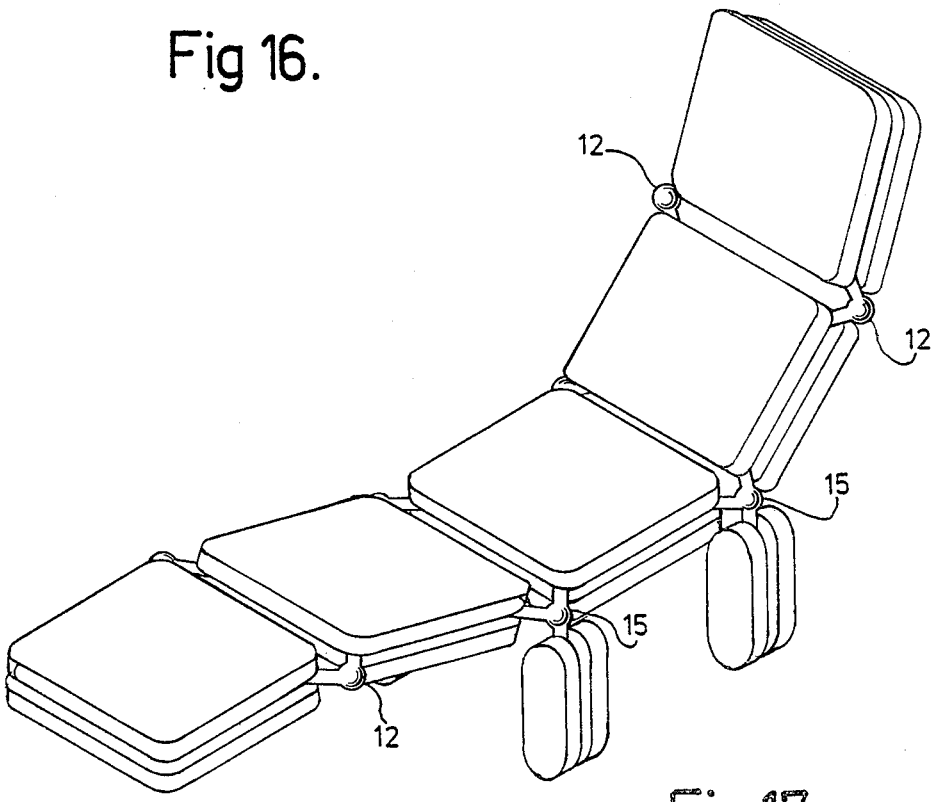

FIGS. 16 and 17 show examples wherein furnitures have been built and both doll's house furniture and true furniture for everyday use can be built. In particular, in furniture for real use, the above mentioned design of the head portions with flat fixing surface areas will be of importance in order to provide the necessary rigity or stability in the structure.

FIG. 17 also illustrates a particular use of angular linking units 12 and of three-dimensional right-angled corner linking units 15. Thus, the arrangements shown provide possibilities of angularly adjusting and fixing the various pairs of plate clamping members relative to each other.

Figure 18:
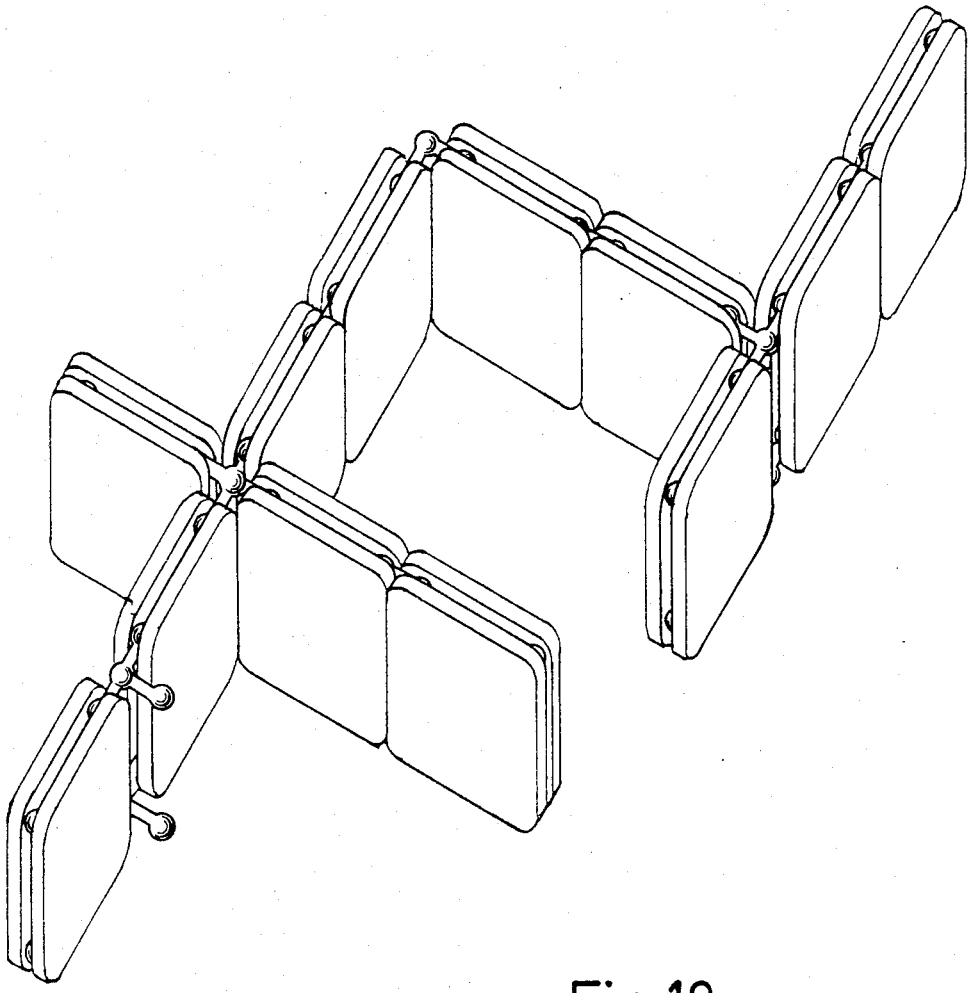

Finally, FIG. 18 shows as an example how the building set according to the invention can be used to construct provisional or removable fences or partition walls. In particular, in connection with this type of use, the plate clamping units can advantageously be constructed of an outer frame which has recesses 3 needed for the head portions of linking units, and this frame could be provided with cover plates or layers and, possibly, an appropriate stuffing or filling inserted therebetween.

The clamping members or plates can, depending on the use contemplated, be prepared of any suitable material such as wood, metal or plastic materials. The linking units can be prepared of metal or plastic materials, for example by injection moulding, or they can be prepared of wood or of plastic balls connected by rods of wood. The connecting rods can have any appropriate length (FIG. 14) and can also be shaped to have e.g. curved or bent configurations.

As already mentioned above, the clamping members have recesses 3 in at least one surface thereof. Recesses can also be provided in both opposite surfaces of the clamping members and, thus, a plurality of members can be clamped together with linking units sandwiched therebetween.

Finally, the head portions or the connecting rods of the linking units may be provided with appropriate shoulders or neck portions which will engage with clamping members tightened about the head portions and thereby lock or stabilize the joints.

In addition to the possibilities of use illustrated and described above, the constructional building set of the invention in also very suitable for providing lightweight and collapsible stands or racks, e.g. for tents or pavillons. In order to be collapsible, such stands or racks need not to be completely disassembled in order to be folded or collapsed into a compact condition.

When erected, such stands or racks can be stabilized just by tightening appropriate clamping members therein.

Many different arrangements may be made within the broad scope of the invention, and it is to be appreciated that the invention is not limited to the specific examples given or to the specific components described and illustrated.

I claim:

1. A constructional building set which comprises as its basic elements a plurality of linking units (5, 11, 12, 13, 14 or 15), each linking unit comprising at least one connecting rod (6) having a generally ball-shaped head portion (7, 8) disposed at each end thereof, and a plurality of coupling members for coupling together linking units by use of said head portions thereof, said building set being CHARACTERIZED in that said coupling members are clamping members (1, 2) having tightening means (4, 9) for urging a pair of clamping members towards each other about head portions (7, 8) of linking units with said head portions being retained in respective recesses (3) formed in at least one surface of said clamping members, said head portions of said linking units having such a size that, when inserted in and between registering recesses of two juxtaposed clamping members being urged together, they hold said two clamping members in spaced apart relation to each other, and said recesses having a flat bottom area, and said head portions having at least two diametrically opposed and flat surface areas.

2. The building set of claim 1 CHARACTERIZED in that at least some of said recesses (3) are disposed at corners of said clamping members, the distance between a central axis (10) of a recess and the edges defining such a corner being substantially equal to one half of the length (C) of said connecting rod (6) of said linking units measured from head portion center to head portion center (FIG. 1).

3. The building set of claim 2, CHARACTERIZED by the clamping member corner at a recess being rounded off with a rounding radius substantially equal to one-half said length (C) of said connecting rod.

4. The building set of claim 3, CHARACTERIZED by said clamping members having a width which is substantially equal to said length (C) of said connecting rod.

5. The building set of any of claims 2, 3 or 4, CHARACTERIZED in that the shape of said recesses and the diameter of said generally ball-shaped head portions have been so adjusted that an assembly of two juxtaposed clamping members, with head portions inserted therebetween, has an overall height which is substantially equal to said center-to-center length (C) of said connecting rod (6) (FIG. 3*c*).

6. A constructional building set comprising a plurality clamping elements for use in pairs to clamp and retain therebetween generally ball-shaped head portions of linking units, each linking unit including at least one connecting rod having a head portion at each end thereof, said clamping element comprising:

socket recesses formed in at least one surface of an element body and arranged symmetrically about orthogonal axes of symmetry of said surface, the socket recesses engaging but being shiftably movable with respect to the ball-shaped head portions of the linking units and providing for spacing of the clamping element bodies from the connecting rods and thereby provide for universal relative angular movement of the linking units with respect to the clamping elements, and an opening defined centrally of said element body between said recesses at the point of intersection of said axes for inserting therein screw means to tighten the clamping element toward another clamping element juxtaposed thereto.

7. A construction as defined in claim 6, wherein said socket recesses are disposed at corners of a generally rectangularly contoured plate-shaped element body.

8. A construction as defined in claim 6, wherein said socket recesses are disposed at uniform spacing from both ends of an elongated, generally bar-shaped element body.

9. A constructional building set which comprises as its basic elements a plurality of linking units (5, 11, 12, 13, 14 or 15), each linking unit comprising at least one connecting rod (6) having a generally ball-shaped head portion (7, 8) disposed at each end thereof, and a plurality of clamping members being of at least one type and adapted for coupling together linking units by use of said head portions thereof, wherein clamping members of the same type are identical, each clamping member comprising socket recesses (3) formed in at least one surface of said member and arranged symmetrically about orthogonal axes of symmetry of said surface so that each clamping member (1) can be matched with any other clamping member (2) of the same type to provide pairs (1, 2) of identical clamping members juxtaposed with the respective socket recesses thereof in register, and wherein each clamping member has at least one opening (4) also arranged symmetrically with respect to said axes of symmetry for inserting therein screw means (9) for tightening said clamping member towards another clamping member juxtaposed thereto about head portions (7, 8) of linking units with said head portins being retained in respective registering and confronting socket recesses (3), said head portions of said linking units having such a size that, when inserted in and between confronting recesses of two juxtaposed clamping members being urged together, they hold said two clamping members in spaced apart relation to each other.

10. A building set as claimed in claim 9, characterized by said recesses having a flat bottom area, and said head portions having at least two diametrically opposed and flat surface areas.

11. A building set as claimed in claim 10, characterized by said head portions being dodecahedrons.

12. A building set claimed in claim 9, characterized in that the clamping members have corners and in that at least some of said recesses (3) are disposed at the corners of said clamping members, the distance between a central axis (10) of a recess and the edges defining such a corner being substantially equal to one-half of the length (C) of said connecting rod (6) of said linking units measured from head portion center to head portion center (FIG. 1).

13. A building set as claimed in claim 12, characterized by the clamping member corner at a recess being rounded off with a rounding radius substantially equal to one-half said length (C) of said connecting rod.

14. A building set as claimed in claim 13, characterized by said clamping members have a width which is substantially equal to said length (C) of said connecting rod.

15. A building system of claim 12, characterized in that the shape of said recesses and the diameter of said generally ball-shaped head portions have been so adjusted that an assembly of two juxtaposed clamping members, with head portions inserted therebetween, has an overall height which is substantially equal to said center-to-center length (C) of said connecting rod (6) (FIG. 3*c*).

16. A building set as defined in claim 9, wherein said socket recesses are disposed at corners of a generally rectangularly contoured plate member.

17. A building set as defined in claim 9, wherein said socket recesses are disposed at uniform spacing from both ends of an elongated, generally bar-shaped member.

* * * * *